United States Patent [19]

Leeper et al.

[11] Patent Number: 4,516,805

[45] Date of Patent: May 14, 1985

[54] MULTI-POSITION EXAMINATION CHAIR

[75] Inventors: Marvin A. Leeper, Versailles; Richard L. Turner, Coldwater, both of Ohio; Terry J. Simpkins, Snowmass Village, Colo.

[73] Assignee: Midmark Corporation, Versailles, Ohio

[21] Appl. No.: 466,706

[22] Filed: Feb. 15, 1983

[51] Int. Cl.[3] ..... A47C 1/02

[52] U.S. Cl. ..... 297/330; 297/320; 297/430; 297/191; 297/219

[58] Field of Search ..... 297/330, 430, 431, 320

[56] References Cited

U.S. PATENT DOCUMENTS

| | | | |
|---|---|---|---|
| 1,211,428 | 1/1917 | Fischrupp | 297/430 |
| 2,714,922 | 8/1955 | McKibban | 297/330 X |
| 2,823,731 | 2/1958 | Miller | 297/320 |
| 3,147,038 | 9/1964 | Barabas | 297/330 X |
| 3,578,379 | 5/1971 | Taylor et al. | 297/330 |
| 3,934,927 | 1/1976 | Zur | 297/330 X |
| 4,168,099 | 9/1979 | Jacobs et al. | 297/330 |
| 4,333,681 | 6/1982 | Nelson | 297/330 |

*Primary Examiner*—Francis K. Zugel

*Attorney, Agent, or Firm*—Biebel, French & Nauman

[57] ABSTRACT

A multi-position examination chair for supporting a patient and assuming sequentially a plurality of obstetric and gynecologic examination positions includes a base. A chair mounted on the base includes a back portion pivotally attached to the base and a seat portion pivotally attached to the back portion. A first linear actuator pivotally moves the back portion into a desired position relative the base, and a linkage cooperates to cause a predetermined amount of pivotal movement of the seat portion relative to the base in response to pivotal movement of the back portion. A second linear actuator power means pivotally moves the seat portion into a desired position relative the back portion. Actuation of one of a plurality of switches cooperates with a control system for movement of the back and seat portions from one of the examination positions to at least a next following one of the positions within the sequence.

9 Claims, 19 Drawing Figures

MULTI-POSITION EXAMINATION CHAIR

BACKGROUND OF THE INVENTION

The present invention relates to an examination chair for supporting a patient during obstetric and gynecologic examinations and, more particularly, to a chair which assumes selected ones of a sequence of a plurality of examination positions to permit a plurality of obstetric and gynecologic examinations to be performed upon the patient.

In the past, gynecologic and obstetric examinations have generally been performed by a physician with the patient supported by a general purpose physician's table. Such a table has a high, flat, hard body support surface and a pair of metal stirrups on either side of the table top surface for receiving the patient's heels so that the pelvic region is exposed for examination. Such a table is extremely uncomfortable for the patient during the examination. Additionally, it is difficult for the patient to climb onto and off of the table surface and to assume the desired examination positions. This difficulty is, of course, heightened when the patient is pregnant. These physical discomforts have added to the mental discomfort and tension which many women experience in such an examination, to make for a highly unpleasant experience.

During the course of an examination by a gynecologist or obstetrician, it may be desired to position a patient in a plurality of standard examination positions such as the lithotomy position and the Trendelenberg position. It may also be desirable to examine the patient with the patient in a flat prone position or to tilt the patient from the lithotomy position to a pelvic tilt position. With most standard prior art examination tables, it has been necessary for the physician to adjust manually the orientation of the examination table, the stirrups, and any movable portions of the table, in order to place the patient in the desired position. This is time consuming and requires a substantial physical effort by the physician.

A variety of examination chairs for use in various medical fields have been developed to provide a power assisted adjustment of the chair orientation. For example, U.S. Pat. No. 3,578,379, issued May 11, 1971 to Taylor et al discloses a chair for use by dentist in positioning a patient for dental examinations. The chair is provided with a base and connected back and seat portions. An electric motor is utilized for raising and lowering the chair relative to the base. A second motor enables the back portion to recline or return to an upright position, and the seat portion is pivotally connected thereto through a spring mechanism such that reclining of the back portion causes the seat portion to be elevated somewhat.

Such a chair is, of course, adapted particularly for use in dental examinations and is not suitable for use by a gynecologist or obstetrician. Moreover, the chair is inherently limited in the variety of positions which it can assume, while a chair adapted for gynecologic and obstetric examinations requires a relatively large number of major position alterations.

An examination chair that is particularly adapted for use by gynecologists and obstetricians is disclosed in U.S. Pat. No. 4,168,099, issued Sept. 18, 1979 to Jacobs et al. The chair includes a plurality of movable chair portions which are movable with respect to each other by means of a hydraulic power arrangement such that the plurality of desired examination positions may be achieved. A plurality of switches are also provided, with each switch associated with a respective one of the examination positions. Actuation of each of the switches thus results in the chair portions moving into the examination position associated with the actuated switch.

The chair provided in the Jacobs et al patent requires not only a mechanical system for connecting the various chair portions and allowing for their pivotal movement, but also a hydraulic fluid supply system for the four hydraulic cylinders used in positioning the chair. Moreover, a relatively complex electric control system, including a printed circuit board, is used for controlling the hydraulic cylinders. Consequently, the examination chair represents a relatively complicated system that is both expensive and difficult to construct. In addition, the hydraulic cylinders and fluid supply system present a potential for fluid spillage, both in the event of a malfunction or during a repair and/or maintenance. Finally, the complex electrical system utilized causes problems for repair and maintenance personnel accustomed to dealing with much simpler systems.

What is need, therefore, is a multi-position examination chair for supporting a patient to permit a plurality of standard obstetric and gynecologic examinations to be performed upon the patient, which chair sequentially assumes selected ones of a plurality of examination positions upon actuation of corresponding ones of a plurality of controls. Such a chair should achieve substantially all of the advantages of a chair such as that described in the Jacobs et al patent, but should be significantly simpler in design so as to enable cost of the chair to be reduced, and construction, maintenance and repair to be facilitated. Such a chair, which would therefore be more within the financial reach of a greater number of gynecologists and obstetricians, would simplify the examination procedure, reducing the patient's tension and at the same time facilitating the examination for the physician.

SUMMARY OF THE INVENTION

A multi-position examination chair for supporting a patient and assuming sequentially a plurality of examination positions which permit a plurality of standard obstetric and gynecologist examinations to be performed upon the patient includes a base means for providing support. A chair, mounted on the base means, includes a back portion supported by and pivotally attached to the base means, a seat portion, and mounting means for supporting and pivotally attaching the seat portion to the back portion. A first power means is provided for pivotally moving the back portion into a desired position relative the base means, and linkage means cooperates with the seat portion mounting means for maintaining the seat portion generally in its initial angular orientation relative the base means throughout pivotal movement of the back portion. A second power means is provided for pivotally moving the seat portion into a desired position relative the back portion. A plurality of switch means are connected to a control means, with each such switch means associated with movement with the back and seat portions from one of the examination positions to at least a next following one of the positions within the sequence. The control means, which is responsive to the plurality of switch means, controls operation of the first and second power means such that actuation of the switch means in accordance with at least a portion of a predetermined sequence results in the back and seat portions moving through the steps of the sequence of examination positions associated with the actuated switch means.

The first and second power means may each include an electric motor controlled by the control means, a screw shaft adapted for rotation by the motor, nut means mounted on the shaft for converting the rotary motion of the shaft to linear motion, and actuator means connected to the nut means for delivering the linear motion to the corresponding chair portion.

The linkage means may include at least one plate member pivotally attached at a first mounting point to the back portion, the seat portion being pivotally attached to the plate member whereby the plate member also forms at least a portion of the seat portion mounting means, and a rod member pivotally connected at one end thereof at a second mounting point to the base means and at an opposite end at a third mounting point to the plate member. The first, second and third mounting points and the point of pivotal attachment between the base means and the back portion define a quadrilateral. The linkage means may further include a mounting member attached to the plate member, the second power means being connected between the mounting member and the seat portion.

The seat portion may be mounted by the attachment means to the back portion so as to provide a slight downward slope along the seat portion surface towards its juncture with the back portion when the chair is in the chair position. The relative proportions of the sides of the quadrilateral defined in part of the linkage means are then selected such that movement of the back portion for placing the chair in the table position causes the linkage means to pivot the seat portion slightly about the attachment means into a horizontal orientation.

The switch means may be a foot-actuated switch assembly including a pair of foot pedals. Each pedal has a neutral position and first and second actuated position. The control means is construced so that no chair movement occurs with both pedals in their neutral positions. Movement of a selected one of the pedals to one of its actuated positions causes corresponding movement of the chair from a first to a second position within the sequence.

Accordingly, it is an object of the present invention to provide an examination chair which sequentially assumes a plurality of examination positions in response to actuation of one or more of a plurality of switch means; to provide such a chair in which the lithotomy, Trendelenberg, and table positions may be achieved; to provide such a chair in which the examination positions may be achieved without returning the chair to its initial chair position; and, to provide such a chair that is of similar design and operation than previous chairs for accomplishing substantially the same purposes.

DETAILED DESCRIPTION OF THE PREFERRED EMBODIMENTS

Figure 1:
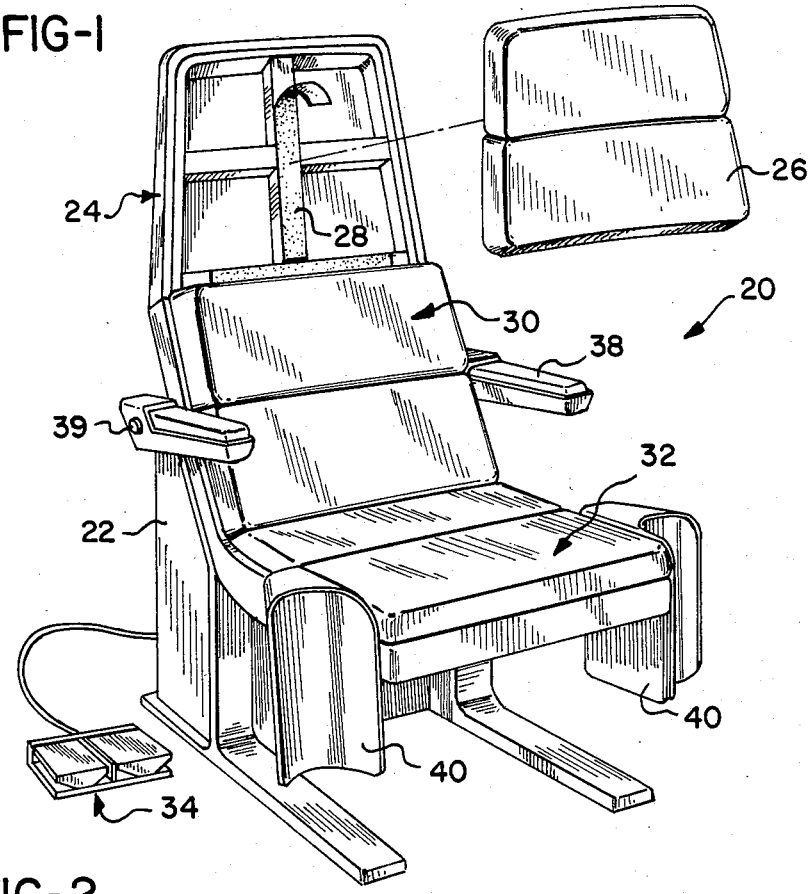
FIG. 1 is a perspective view of the multi-position examination chair of the present invention in the chair position, showing a section of upholstery removed from the chair.
Figure 2:
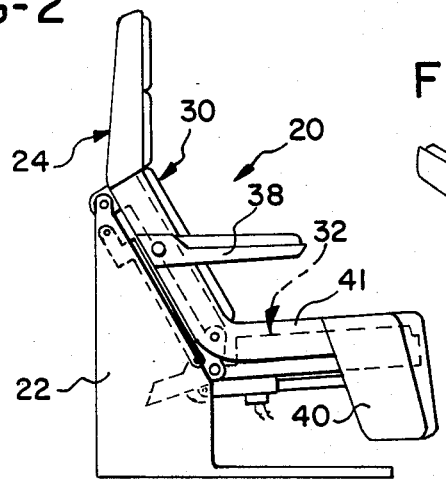
FIG. 2 is a side view of the chair in the chair position.

Referring generally to FIG. 1, the multi-position examination chair 20 of the present invention is shown. The chair 20 includes a base means 22 to which a chair frame 24 is mounted. A plurality of upholstery sections 26 are removably mounted to chair frame 24 by "Velcro" strips 28 or the like so that upholstery sections 26 may be easily removed for cleaning or repair.

The chair frame 24 defines a back portion 30 pivotally attached to the base 22 and a seat portion 32 pivotally attached to the back portion 30. A plurality of power means, not seen in FIG. 1, are provided for moving the chair portions into various positions such that the plurality of examination positions may be achieved. A foot actuated control 34 includes a plurality of switch means which, along with a control means responsive to the switch means, controls operation of the power means such that actuation of the switch means causes movement of the chair 20 through a sequence of examination positions.

The sequence of examining positions which the chair 20 may assume are shown generally in FIGS. 2 through 6. The patient may be seated quite easily in the chair 20 when it is in the chair position shown in FIG. 2. After the patient is comfortably seated in the chair and a proper rapport has been established between the physician and the patient, the chair 20 is positioned into the table position illustrated in FIG. 3. A foot rest 36 may be extended from the seat portion 32 to support the patient's feet. A pair of arm rests 38, normally positioned as shown in FIG. 1, are provided with conventional push-button release-type means. Depression of buttons 39 on arms 38 allow the arms to be lowered.

Figure 4:
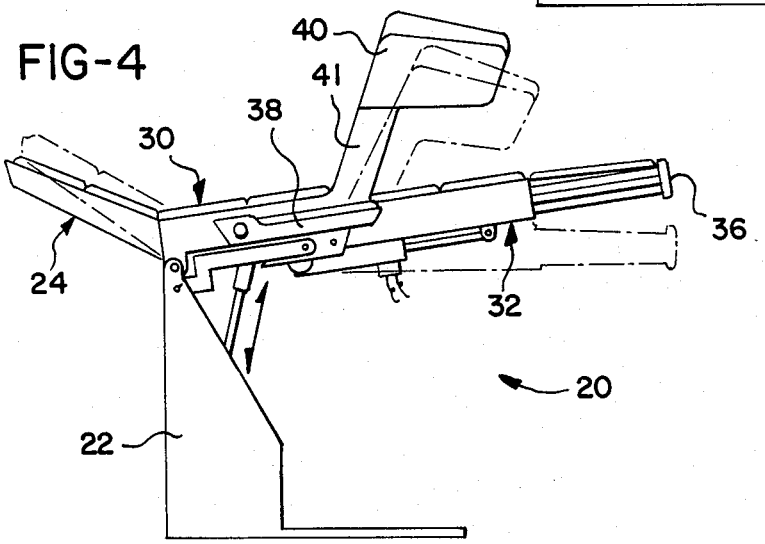
FIG. 4 is a side view of the chair in the Trendelenberg position.

The chair 20 may then be further inclined from the table position by an additional 10° to the Trendelenberg position shown in FIG. 4.

Figure 5:
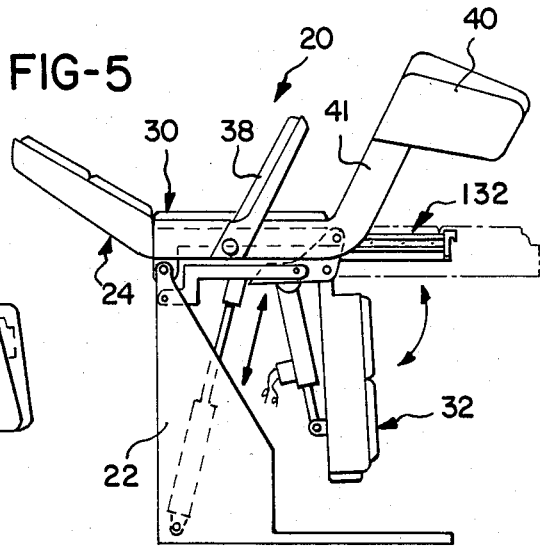
FIG. 5 is a side view of the chair in the lithotomy position.

Alternatively, the chair 20 may be moved from the table position into the lithotomy position shown in FIG. 5. The patient's legs are cradled from the bottom and sides of the calves by leg supports 40 which are mounted to the back portion 30 of the chair. By moving from the chair position through the table position into the lithotomy position, the patient may initially position the legs within supports 40 and need not lift the legs for movement into the lithotomy position. Moreover, no manual effort is required on the part of the physician in order for the patient to be positioned properly. Supports 40 are carried on a pair of mounting members 41, one member 41 being rigidly attached to the chair frame 24. The supports 40 are mounted to members 41 by pivotal mounting means (not shown) so that supports 40 can assume an orientation most comfortable to the patient.

Figure 6:
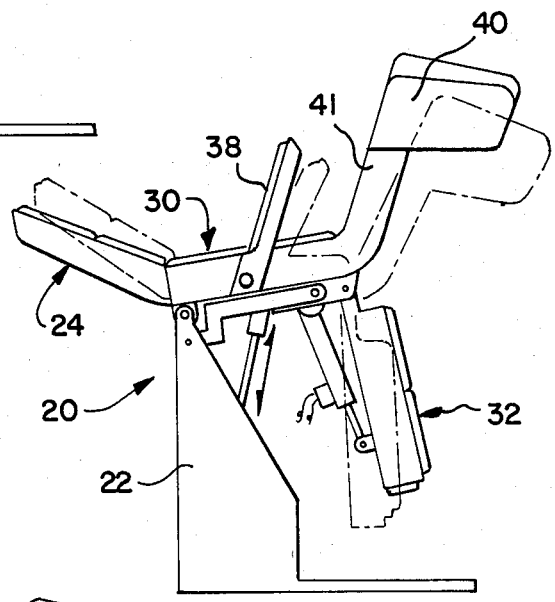
FIG. 6 is a side view of the chair in the pelvic-tilt position.

As with the table position, the chair 20 may be raised an additional 10° to the pelvic tilt position as shown in FIG. 6.

The control arrangement of the present invention is extremely flexible in that the chair may be moved to any of its examination positions from any of the other examination positions without returning to the initial chair position. As may be seen from FIG. 7, however, the mechanical system of the chair 20 is substantially simpler than that of known chairs having the ability to assume the same examination positions.

Figures 7, 12:
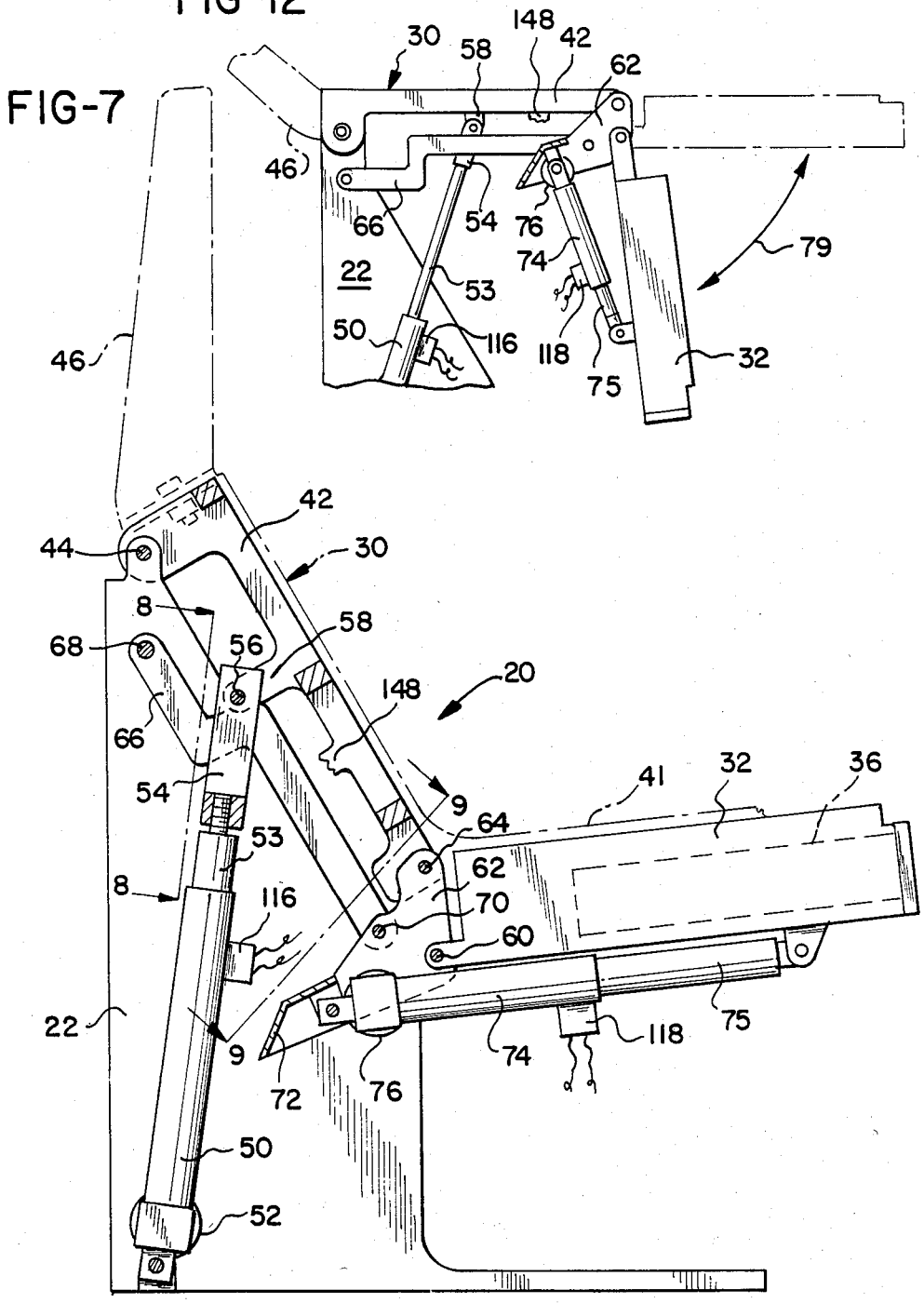
FIG. 7 is a sectional side view of the chair in the chair position with portions removed for clarity, showing the mechanism for movement of the chair for various positions.
FIG. 12 is a partial side view, similar to FIG. 7, showing the chair in the lithotomy position.

The examination chair 20 is seen in the upright chair position in FIG. 7 with the upholstery sections removed for clarity. The back portion 30 includes a frame 42 pivotally mounted by pin 44 to base 22. An upper back portion 46 is attached to frame 42. Upper portion 46 is mounted at an angle with respect to frame 42. This elevates the patient's head in all but the chair position, so that patient-physician communication and patient comfort during the examination may be facilitated. Additionally, leg support mounting members 41 are rigidly attached by an appropriate connecting means such as screws or the like (not shown) to each side of frame 42. As noted, leg supports 40 are carried at the lower ends of mounting members 41.

The back portion 30 is moved relative base 22 through a first power means which includes lead screw actuator 50, powered by an electric motor 52. Actuator 50 and motor 52 may be any appropriate commercially available unit, such as those manufactured by Motion Systems Corp. of Shrewsbury, N.J. Actuator 50 includes a screw shaft and gearing means or the like for enabling motor 52 to rotate the shaft. A nut means is mounted on the shaft for converting the rotary motion of the shaft into linear motion, and an actuator arm 53 is connected to the nut means for delivering the linear motion to back portion 30. The screw shaft, gearing means, and nut means are all contained within a cylindrical actuator housing, while arm 53 extends outwardly therefrom.

Figure 8:
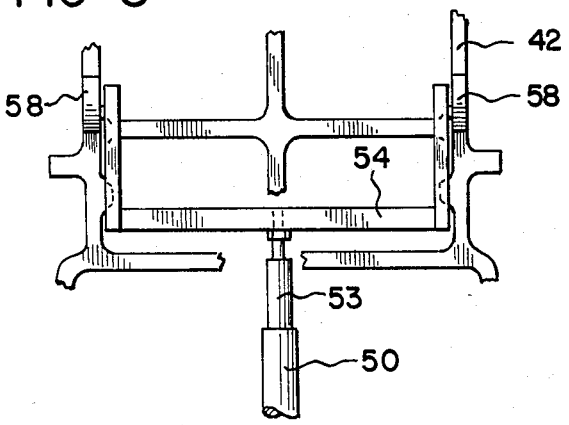
FIG. 8 is a view taken generally along line 8—8 of FIG. 7.

The actuator 50 is pivotally mounted at its lower end within base 22, and the upper end of arms 53 is fixedly mounted to a yoke 54, shown also in FIG. 8. Yoke 54 is in turn pivotally mounted by pins 56 to a tab 58 projecting from either side of frame 42. Thus, extension or retraction of actuator arm 53 causes frame 42 to pivot about pins 44 for movement of back portion 30.

Seat portion 32 is pivotally mounted by pins 60 to a pair of plate members 62. Plate members 62 are in turn pivotally mounted by pins 64 to frame 42. A linkage means is defined by rod members 66, each of which is pivotally connected by a pin 68 to base 22 and by a pin 70 to plate member 62. The pivotal mountings between frame 42, base 22, rod member 66, and plate member 62 are such that the locations of pins 44, 64, 68 and 70 define a quadrilateral.

It will be noted that in the chair position shown in FIG. 7, seat portion 32 is held in an orientation so as to form an angle of approximately 5° with respect to the ground or floor, sloping slightly toward its connection with back portion 30. This slope encourages the patient, upon sitting down initially, to position the back flat against back portion 30, helping to insure proper positioning of the patient for later examination positions.

Figure 9:
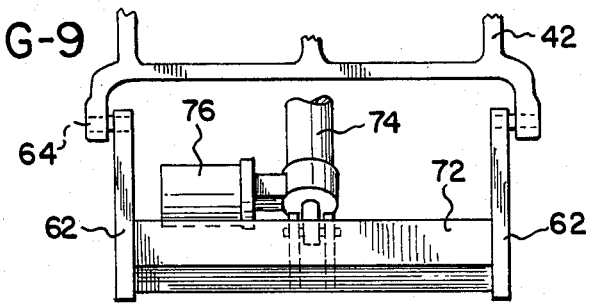
FIG. 9 is a view taken generally along line 9—9 of FIG. 7.

Plate members 62 are connected by a cross member 72, shown in FIG. 9, which serves as a mounting for the second power means. This power means includes an actuator 74 that is powered by an electric motor 76, similar to actuator 50 and motor 52, connected at one end to cross member 72. Actuator member 74 includes an actuator arm 75 pivotally connected at its outer end to seat portion 32. It should be recognized that when actuator arm 75 is held at a single position, the seat portion 32 will remain at a constant angular orientation with respect to the plate member 62.

Figure 10:
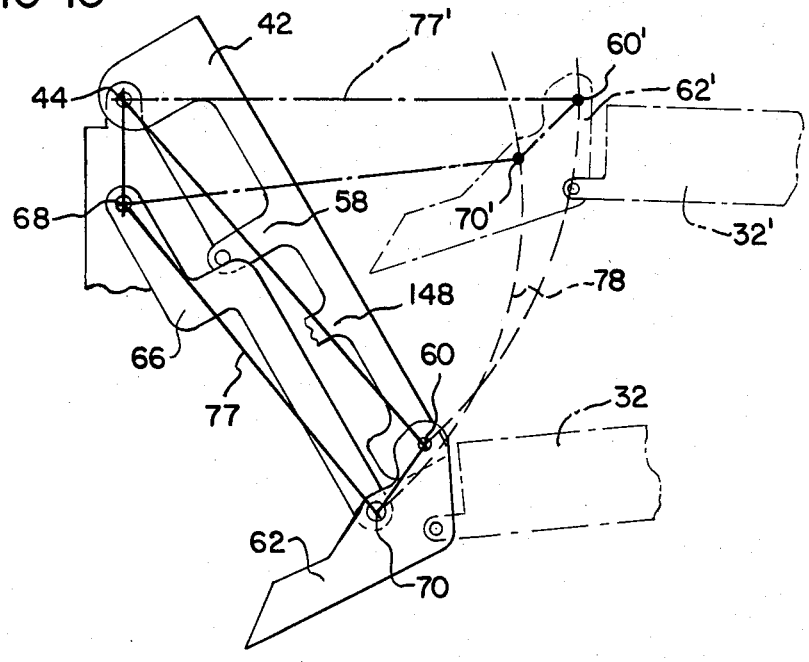
FIG. 10 is a partially schematic view illustrating the operation of portion of the chair mechanism in moving the chair from the chair to the table positions.

FIG. 10 illustrates schematically the movement and operation of the frame 42, rod member 66, and plate member 62 during energization of actuator 50. When chair 20 is in the chair position, pins 44, 60, 68 and 70, shown in FIG. 10 as points having similar reference numbers, define a quadrilateral 77. Extension of actuator arm 50, for movement of chair 20 to the table position, which in turn moves from 42, causes the segment of quadrilateral 77 between pins 44 and 64 to pivot about pin 44 to the position indicated in quadrilater 77'. The segment between pins 44 and 68, since it represents a portion of the fixed base 22, remains stationary. The segment between pins 68 and 70 pivots about pin 68, with pin 70 moving along curve 78 to the position shown by pin 70'.

The segments between pins 64 and 70 and 64' and 70' illustrate the orientation of plate members 62 during movement of back portion 30 from its chair position location to that corresponding to the table position. Since in the absence of energization of actuator 74 seat portion 32 will retain its same angular orientation relative plate members 62, movement of back portion 30 results in seat portion 32 remaining in generally the same angular orientation relative to the ground or floor. More precisely, however, plate members 62 are slightly rotated during movement of back portion 30, so that seat portion 32 is in fact lowered by approximately 5° to bring it to a horizontal orientation in the table position.

Figure 11:
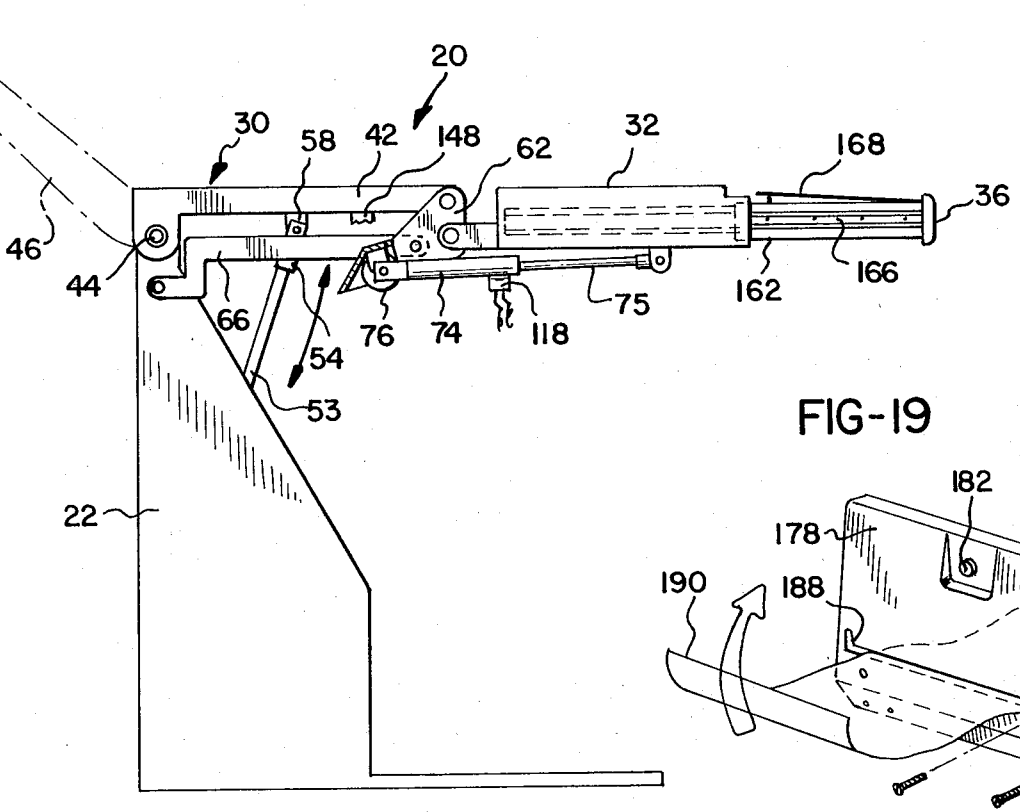
FIG. 11 is a view, similar to FIG. 7, showing the chair in the table position.

Thus, chair 20 is moved from the chair position shown in FIG. 7 to the table position shown in FIG. 11 through energization of the single actuator 50. Once chair 20 is in the table position, footrest 36 may be extended as shown, but must be retracted within seat portion 32 for movement of chair 20 into the lithotomy position.

As seen in FIG. 12, the chair 20 is moved from the table position to the lithotomy position by operation of actuator 74. This lowers seat portion 32 as shown by arrow 79. It is understood, of course, that prior to lowering of seat portion 32, the patient's legs will have been supported by leg supports 40 (not shown in FIG. 12).

Return of the chair 20 to the chair position from the lithotomy position of FIG. 12 requires operation of actuator 74 to initially move the chair to the table position, whereupon energization of actuator 50 returns the chair 20 to the chair position. Additionally, further operation of actuator 50 to move arm 53 in an extension direction will move the chair 20 from the table and lithotomy positions into the Trendelenberg and pelvic tilt positions, respectively. These latter positions are illustrated in FIGS. 4 and 6.

Figure 13:
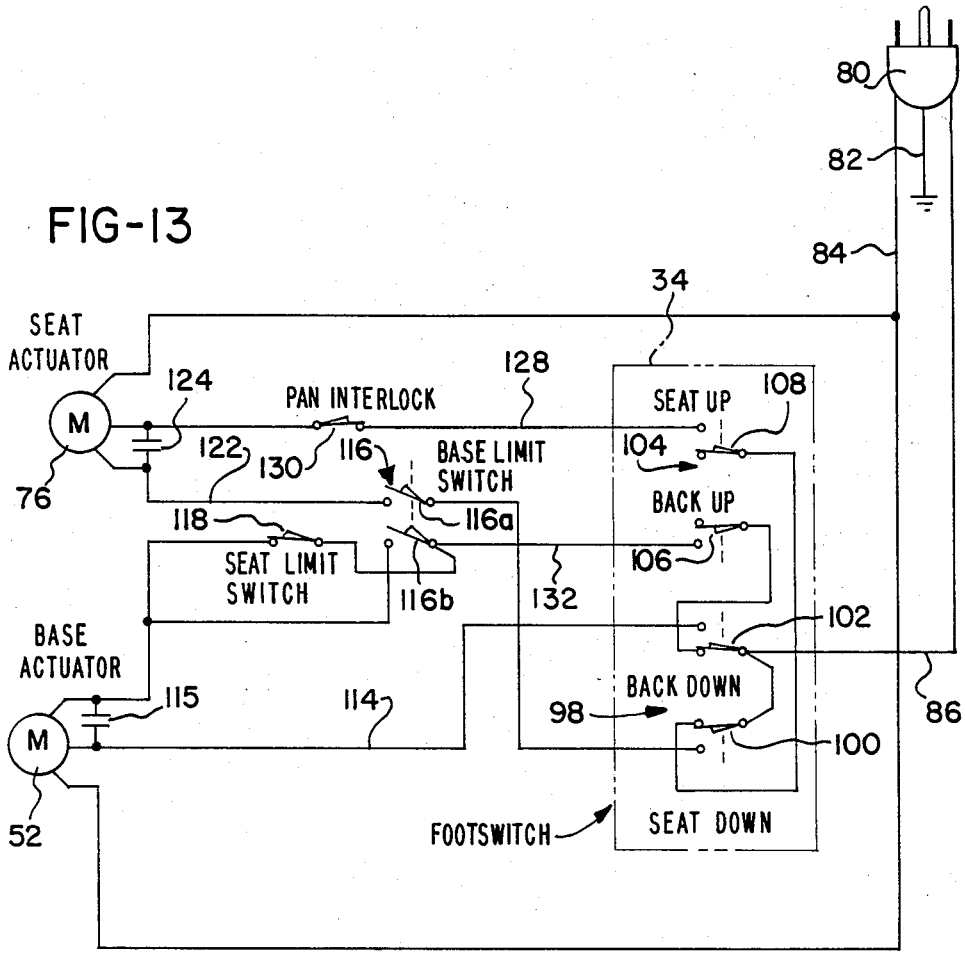
FIG. 13 is a schematic representation of the electrical control circuit of the present invention.

The electrical control means for controlling actuators 50 and 74 to move the chair 20 through the various positions is illustrated schematically in FIG. 13. A standard 3-prong plug 80 is provided, to which is connected a ground wire 82. Actuator motors 52 and 76, which both operate on common line voltage such as 120 volts AC, are connected by return line to plug 80. Foot switch assembly 34 is also connected to plug 80 by line 86.

Figure 14:
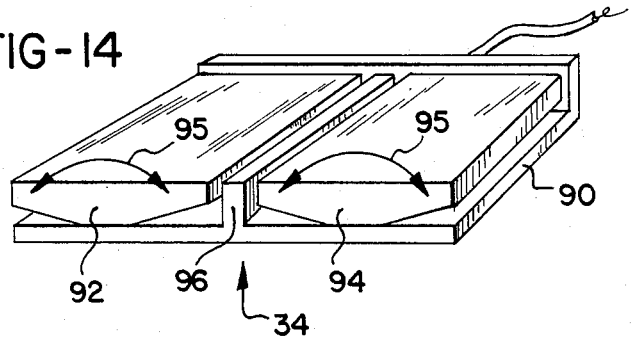
FIG. 14 is a perspective view showing the foot switch assembly for controlling the chair.

The foot switch assembly 34 is shown in detail in FIG. 14. Assembly 34 includes a support frame 90, to which a pair of foot pedals 92 and 94 are mounted. Pedals 92 and 94 are provided with appropriate springs (not shown) so that the chair operator may place a foot on either pedal 92 or 94 and rock it to either the right or left, indicated by arrows 95. Upon removing the foot from the pedal, the pedal 92 or 94 will return to its initial centered position. Support frame 90 further includes a baffle 96 mounted between pedals 92 and 94 so that accidental movement of both pedals 92 and 94 simultaneously can be prevented.

Referring again to FIG. 13, each pedal 92 and 94 of foot switch assembly 34 selectively operates one of a pair of single contact switches. A first switch pair 98 includes switches 100 and 102 shown in their unactuated positions. Movement of pedal 92 to the left operates switch 100, while movement of pedal 92 to the right operates switch 102. Releasing pedal 92 causes it to revert to its center position, whereupon neither switch 100 or 102 is actuated.

Similarly, a switch pair 104 including switches 106 and 108 correspond to pedal 94. Operation of these switches in response to movement of pedal 94 to the left or right is identical to those associated with pedal 92.

Operation of the circuit of FIG. 13 will be discussed with reference to FIG. 15, which illustrates by way of a flow chart the sequence of examination of positions through which the chair 20 may be moved. Beginning with the chair position indicated by block 110, the chair may be moved to the table position shown as block 112. To produce this movement, the operator moves pedal 92 to the right, operating switch 102, whereupon power from line 86 is directed to motor 52 through line 114. Line 114, which is also connected to a starting capacitor 115 for motor 52, is connected to an appropriate terminal of motor 52 such that energization of motor 52 through line 114 causes motor 52 to operate actuator 50 in an extension mode. Motor 52 will continue to operate, moving chair 20 toward the table position, so long as pedal 92 remains depressed. Upon release of pedal 92, switch 102 returns to its original position, terminating operation of motor 52 and halting movement of the chair.

Further operation of pedal 92 to actuate switch 102 will cause motor 52 to move actuator arm 53 to its maximum extension, thereby inclining the chair portions into the Trendelenberg position. Movement to this position is indicated in FIG. 15 as movement from block 112 to block 114.

Referring briefly back to FIG. 7, a limit switch 116 is mounted to the exterior housing of actuator 50. Switch 116, which may be a reed switch or and other appropriate type is operated in response to movement of actuator arm 53 to a particular predetermined position. Specifically, switch 116 is mounted such that movement of actuator arm 53 to a position corresponding to placement of the chair portions into the table position actuates switch 116.

Similar switch 118 is mounted to the exterior housing of actuator 74. This switch is positioned to be operated upon full extension of actuator arm 75, as when the chair portions are in the table or chair positions.

Returning the FIG. 13, switch 116 is a double-pole single-throw switch including two contact sets **116*a* and 116*b*. Both contacts 116*a* and 116*b* are open when chair 20 is in the chair position, and close upon movement of the chair into the table position or beyond into the Trendelenberg position. Switch 118, however, is a single-pole single-throw switch including only a single contact set. Upon any retraction of actuator arm 75 and, thus, any downward movement of seat portion 32, switch 118 is opened. By returning seat portion 32 to its fully elevated position, switch 118** is closed.

Figure 15:
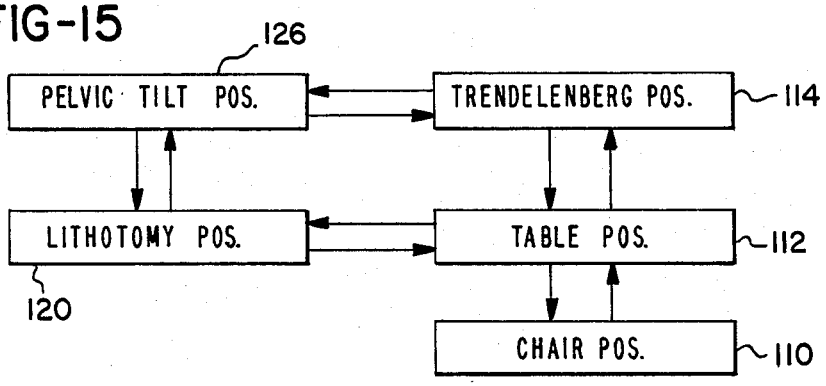
FIG. 15 is a flow chart diagram illustrating the sequence of positions which the chair may assume.

The examination chair 20 may also be moved from the table position to the lithotomy position, indicated at block 120 of FIG. 15. This movement is accomplished by rotation of pedal 92 to the left, thereby actuating switch 100. Since the chair 20 moves from the table position, switch **116*a* is closed and motor 76 is energized through line 122. Line 122 is connected to an appropriate terminal of motor 76, such that motor 76 is energized to retract actuator arm, 75, thereby lowering seat portion 32. Line 122 is additionally connected to a starting capacitor 124**.

The chair 20 may be moved from the lithotomy position to the pelvic-tilt position, shown at block 126 of FIG. 15, by again depressing pedal 92 to the right. This again energizes motor 52 through line 114, causing actuator arm 53 to move to its maximum extension.

The chair 20 may be returned from the lithotomy to the table position, or moved from the pelvic-tilt position to the Trendelenberg position, by depressing pedal 94 to the right. This closes switch 108, supplying power to motor 76 through line 128, causing operation of motor 76 in the opposite direction. Actuator arm 75 is thereby extended, returning chair portion 32 to its raised position. It will be noted that power to line 128 must additionally pass through switch 100, and may only do so when pedal 92 is in its neutral position. This prevents motor 76 from being energized in both the forward and reverse directions simultaneously. Line 128 also includes a pan interlock switch 130 which will be discussed in detail below.

The chair 20 may be moved from the Trendelenberg to the table position, and in turn from the table position to the chair position, by movement of pedal 94 to the left. This applies power from line 86 through switch 106 into line 132. Power to line 132 must pass through switch 102 as well, to prevent simultaneous forward and reverse energization of motor 52. When chair 20 is initially in the Trendelenberg position, switch **116*b* is closed and power is supplied to motor 52 through line 134, whereupon actuator arm 53 is retracted to bring chair 20** into the table position.

Since switch **116*b* is still closed when the chair 20 is in the table position, continued movement of pedal 94 to the left causes actuator 50 to retract to slightly below the table position. Once the chair 20 has moved from the table position, switch 116*b* will open, whereupon power to motor 52 must pass through switch 118. So long as actuator arm 75 is in its fully extended position, this will not affect the operation of chair 20. In the event seat portion 32 is in a lowered position, however, switch 118 will be open, and operation of motor 52 will be stopped. Thus, switch 118 is provided to prevent retraction of actuator arm 53 when seat portion 32 is in its lowered position. It can be seen from FIG. 12, for example, that such movement would draw the lowered seat portion 32 into base 22, thereby possibly damaging chair 20**.

Having described the basic construction and operation of chair 20, several additional features should be noted. In many instances, during the course of an examination, it may be necessary for the physician to have medical instruments within easy reach, or a pan of fluid located for use in irrigiating the pelvic region. Accordingly, a pan support frame 132 is mounted beneath back portion 30 of chair 20. As seen in FIG. 5, when chair 20 is moved to the lithotomy position, a portion of support frame 132 may be withdrawn from beneath back portion 30 through the space created by lowering of seat portion 32.

Figure 16:
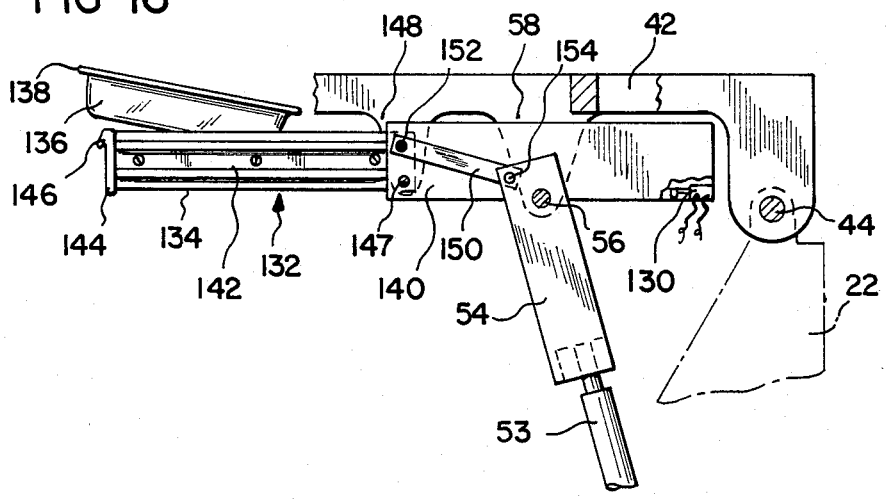
FIG. 16 is an elevational view of a portion of the chair frame, showing mounting of the pan support frame.

The pan support frame 132 is shown in detail in FIG. 16, with frame 42 positioned in the orientation assumed with chair 20 in the lithotomy position. It will be noted that while support 132 in permanently mounted within chair 20, it has been omitted from a number of the drawings, such as FIG. 7, for clarity. Support frame 132 includes an inner frame 134 within which a pan 136 having an upper flange 138 may be placed. Inner frame 134 is appropriately sized so that pan 136 is supported thereby by engagement of flange 138 with the sides of inner frame 134.

Inner frame 134 is supported within outer frame 140 by a conventional slide mounting including inner member 142 mounted to inner frame 134 and a corresponding outer member (not shown) mounted to outer frame 140. Inner frame 134 may thus be withdrawn from or inserted into outer frame 140, and inner frame 134 includes an end panel 144 having a gripping flange 146 for facilitating such withdrawal.

Outer frame 140 is partially supported beneath back portion 30 by pivotal mounting by pins 147 to a tab 148 projecting downwardly from each side of frame 42. Outer frame 140 is disposed within yoke 54, and is further supported on each side by a linkage 150 pivotally connected at one end by pin 152 to outer frame 140 and at the other end by pin 154 to yoke 54.

It can easily be seen from FIG. 5 that inner frame 134 must be positioned within outer frame 140 for movement of seat portion 32. Thus, an interlock switch 130 is mounted within outer frame 140 so as to be electrically closed only when inner frame 134 has been fully inserted into outer frame 140. Referring back to FIG. 13, motor 76 can only be energized for raising seat portion 32 through line 128 and switch 130, thereby preventing raising of seat portion 32 with inner frame 134 withdrawn. Since it would be extremely difficult to withdraw inner frame 134 with seat portion 32 in its raised position, no interlock is provided from energizing motor 76 to lower seat portion 32. It can easily be seen, however, that should such protection be desired, an additional interlock switch may be placed in line 122.

Figure 17:
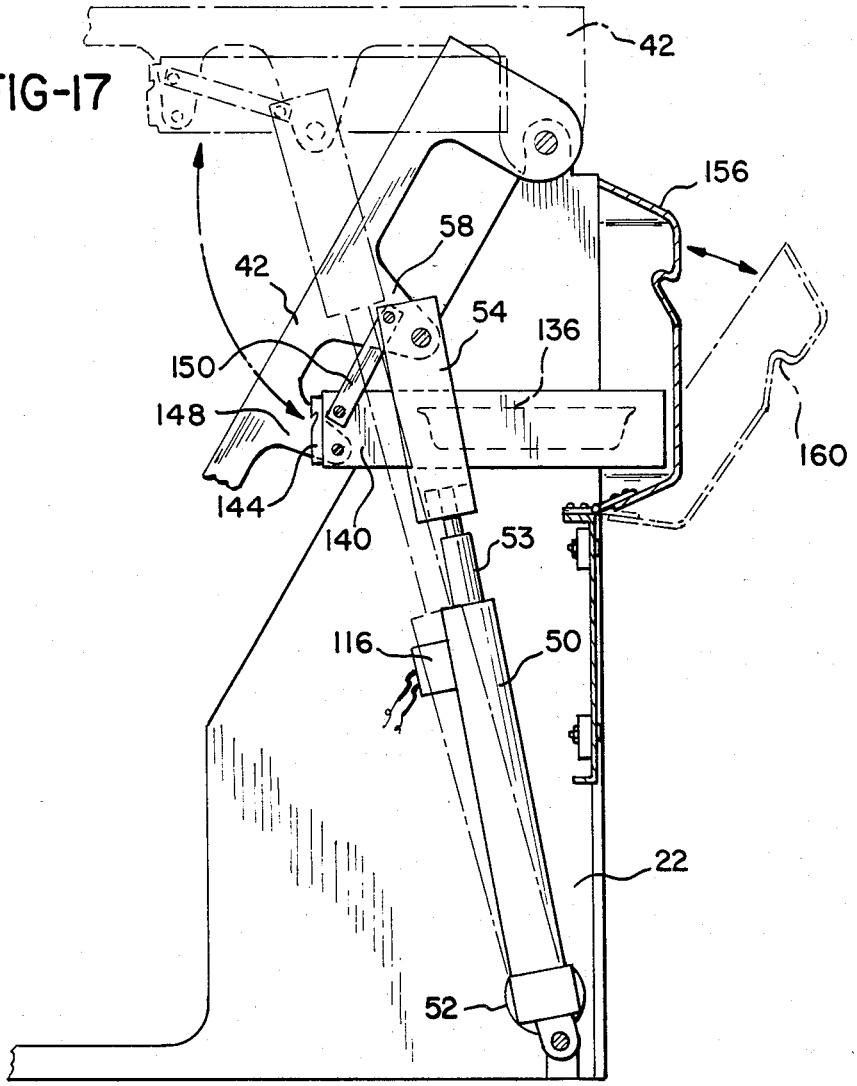
FIG. 17 is an elevational view of a portion of the chair base and frame, illustrating movement of the pan support frame during movement of the chair frame.

The cantilevered, pivotal mounting of pan support frame 132 within chair 20 is provided so as to maintain frame 132 and pan 136 in a horizontal position regardless of pivotal movement of frame 42, as is shown in FIG. 17. As a result, objects placed within pan 136 will remain in place, and fluid within pan 136 will be retained, regardless of the position assumed by chair 20 or movement of chair 20 thereto or therefrom.

An appropriate latching means (not shown) such as hooks or magnets is provided for preventing movement of inner frame 134 relative to outer frame 140 during movement of the chair 20. This latching means not only prevents unwanted movement of pan 136 and movement and/or spillage of its contents, but also insures that pan interlock switch 130 remains closed when inner frame 134 is within outer frame 140.

A cover 156 is mounted by hinges 158 to the rear of base 22, and may be provided with latches, magnets, or springs (not shown) for holding cover 156 in a closed position. Cover 156 is further provided with a recess handle 160 to facilitate its opening. Access to pan 136 is therefore provided when chair 20 is in the chair position. Accordingly, objects or fluid may be placed in pan 136 with chair 20 in the chair position, such as prior to the patient's arrival, for use after chair 20 has been moved to the lithotomy position.

Figure 3:
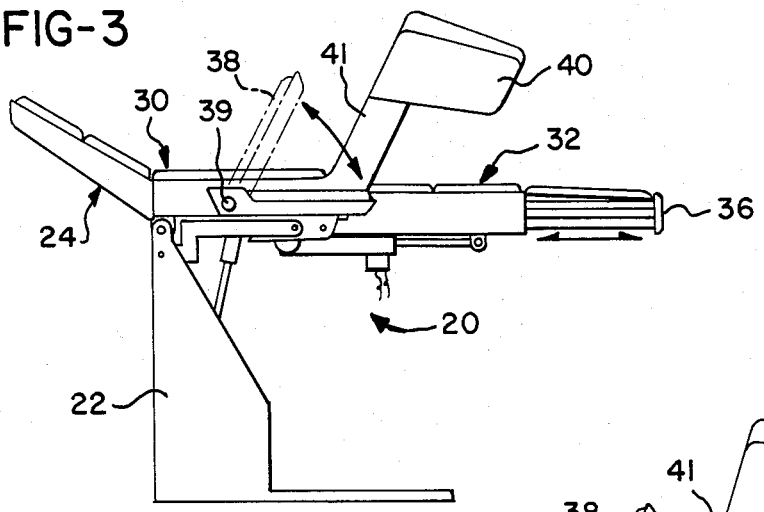
FIG. 3 is a side view of the chair in the table position.
Figure 18:
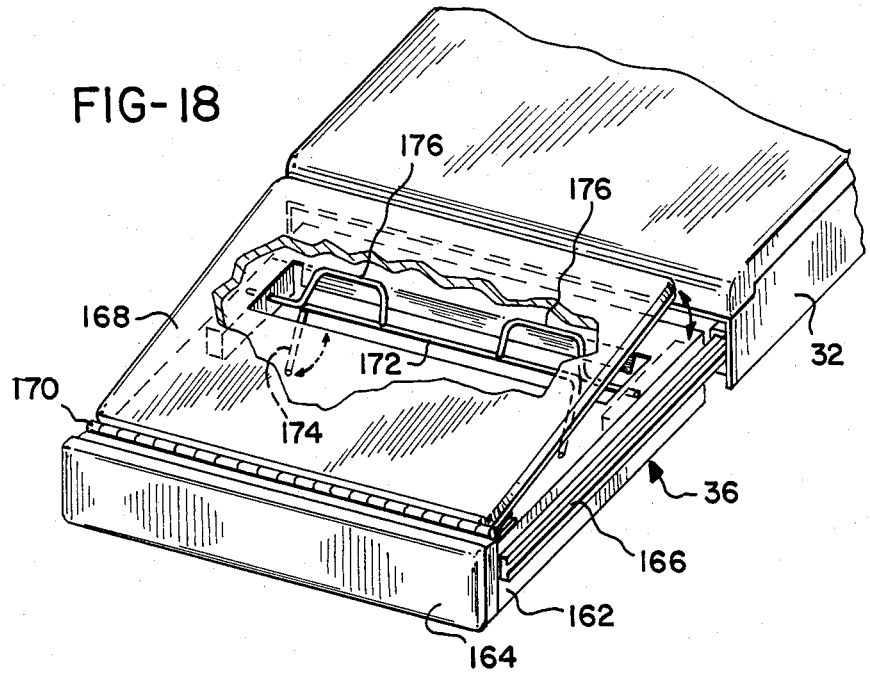
FIG. 18 is a perspective view of the foot rest assembly in an extended state, showing a portion of the support surface broken away.

Seat portion 32 is provided with a foot rest 36 which may be withdrawn therefrom when chair 20 is placed in the table or Trendelenberg positions as seen in FIGS. 3 and 4. Foot rest 36, shown in detail in FIG. 18, is mounted within seat portion 32 in drawer-like fashion and includes a frame having sides 162 and an end panel 164. A conventional slide mounting has its inner portions 166 attached along frame sides 162 and its outer portions attached within chair portion 32. An appropriate latching means (not shown) such as hooks or magnets is provided for retaining the foot rest within chair portion 32 when the latter is lowered from the lithotomy or pelvic tilt positions.

Foot rest 36 further includes an upholstered surface member 168 carried on the foot rest frame. It has been found that when foot rest 36 is in use, placement of the patient's calves against the edge of seat portion 32 where surface member 168 is at a slightly lower elevation represents a source of patient discomfort. Thus, surface member 168 is carried by the foot rest frame by attachment through hinge 170 to front panel 164. An actuation bar 172 is rotatingly mounted between frame sides 162, and includes radially projecting handles 174 and oppositely projecting loops 176 that together operate as a lever. Once foot rest 36 has been extended from seat portion 32, a handle 174 may be grasped and rotated downwardly. Loops 176 are then caused to rotate upwardly, engaging supporting surface 168 and pivoting it upwardly about hinge 170. A substantially smooth joint is thereby created between the surface of seat portion 32 and supporting surface 168, defining a substantially contiguous surface.

Of course, it will be recognized that the foot rest arrangement shown in FIG. 18 with its inclinable support member 168 can be equally used with any apparatus for supporting a patient to facilitate performance of a medical examination upon the patient, such as a conventional examination table. The apparatus includes a primary support surface for supporting the patient and a base means for supporting the surface, with the foot rest frame slidably mounted beneath and at one end of the primary support surface. Movement of handle 174 causes loops 176 to raise one end of support member 168, defining a substantially contiguous surface with support member 168 and the primary support surface.

Figure 19:
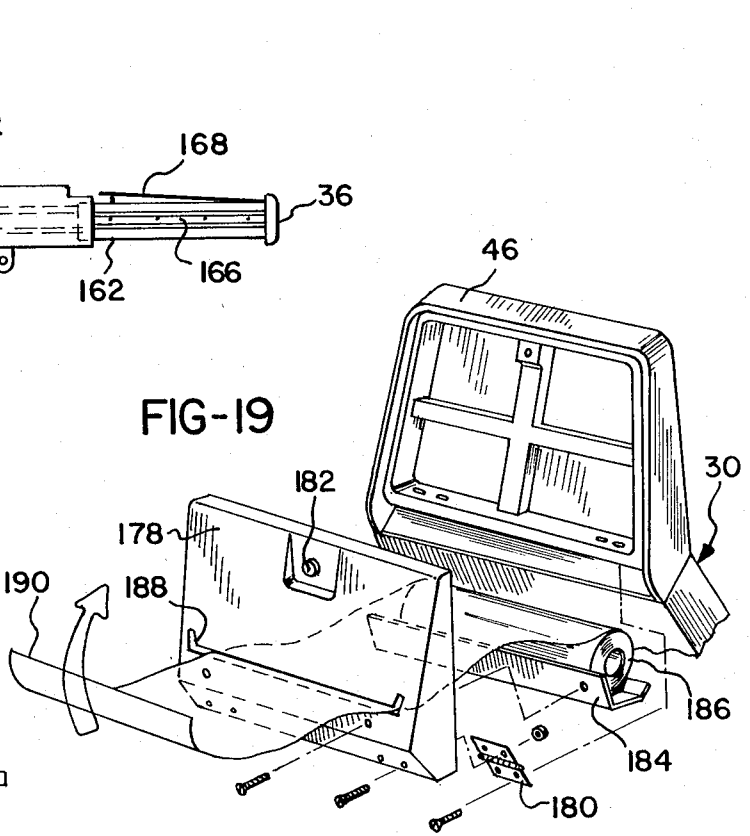
FIG. 19 is a rear exploded view of the back portion of the chair, showing means for mounting a paper roll therein.

It is common for reasons of hygiene to provide various types of medical examination tables with paper for covering the table surface that may be changed after each patient. Accordingly, within upper back portion 46 of chair 20, means for holding and dispensing a roll of such paper is provided as shown in FIG. 19. A cover 178 is mounted through a pair of hinges 180 (only one shown) to the rear of upper back portion 46, and an appropriate latch 182 is provided for retaining cover 178 in the closed position. A tray 184 for supporting the roll 186 is attached to the inside of cover 178, through which a slot 188 is defined for passing the leading edge 190 of roll 186 therethrough. The paper may then be extended over the upper back portion 46 and down along the upholstered surface of chair 20.

It will be recognized that extension of the paper along the full length of chair 20 will interfere with the use of the pan 136 when chair 20 is in the lithotomy position. Accordingly, it may be desirable to provide a second means for holding and dispensing a roll of paper similar to that shown in FIG. 19 within the bottom of seat portion 32. In such a case, paper from the first roll 186 is extended along the surface of only back portion 30, while paper from the second roll is extended between the sections and along seat portion 32.

While the forms of apparatus herein described constitute preferred embodiments of this invention, it is to be understood that the invention is not limited to these precise forms of apparatus, and that changes may be made therein without departing from the scope of the invention, which is defined in the appended claims.

What is claimed is:

1. A multi-position examination chair for supporting a patient and assuming sequentially a plurality of examination positions which permit a plurality of standard obstetric and gynecologic examinations to be performed upon the patient, comprising:

base means for providing support;

a back portion supported by and pivotally attached to said base means;

first power means for pivotally moving said back portion into a desired position relative to said base means;

a seat portion;

mounting means pivotally attached to said back portion and pivotally attached to said seat portion;

linkage means for defining a pivotally connected quadrilateral having first, second, third and fourth sides, said first side being fixed with respect to said back portion, said second side being connected to said first side and fixed with respect to said mounting means, said third side being connected to said second side, and said fourth side being connected between said third and first sides and fixed with respect to said base means;

said linkage means causing a predetermined amount of pivotal movement of said mounting means relative to said base means in response to pivotal movement of said back portion;

second power means for pivotally moving said seat portion into a desired position relative to said mounting means;

a plurality of switch means, each such switch means associated with movement of said back and said seat portions from one of said examination positions to at least a next following one of said positions within said sequence; and control means, responsive to said plurality of switch means, for controlling operation of said first and second power means in accordance with at least a portion of a predetermined sequence which results in said back and said seat portions moving through the steps of said sequence of said examination positions associated with the actuated switch means.

2. The examination chair as defined in claim 1, wherein said first side is formed by said back portion, said second side is formed by said mounting means, said fourth side is formed by said base means, and said third side is formed by a rod pivotally connected between said mounting means and said base means.

3. The examination chair as defined in claim 2, wherein said mounting means includes a plate member pivotally connected to said back portion, said seat portion and said rod, and a cross member attached to said plate member substantially perpendicular thereto, said second drive means being connected to said cross member.

4. The examination chair as defined in claim 1 wherein said first and said second power means each include an electric motor controlled by said control means, a screw shaft adapted for rotation by said motor, nut means mounted on said shaft for converting the rotary motion of said shaft into linear motion, and actuator means connected to said nut means for delivering said linear motion to the corresponding chair portion.

5. The examination chair as defined in claim 1 wherein said plurality of switch means includes a plurality of foot-actuated switches, each said switch having a neutral and at least one actuated position, said actuated positions corresponding to one of said switch means and to movement of said chair portion from at least one position to at least a next following position within said sequence.

6. The examination chair as defined in claim 1 wherein said control means includes means for preventing operation of either of said power means such that actuation of one of said switch means corresponding to movement of said back and said seat portions to one of said examination positions from another of said positions other than in accordance with said sequence is prevented.

7. The examination chair as defined in claim 6 wherein said operation prevention means includes at least one switch means responsive to movement of one of said power means to or past a predetermined position.

8. A multi-position examination chair for supporting a patient and assuming sequentially a plurality of examination positions which permit a plurality of standard obstetric and gynecologic examinations to be performed upon the patient, comprising:

base means for providing support;

a back portion supported by and pivotally attached to said base means;

first power means for pivotally moving said back portion into a desired position relative to said base means;

a seat portion;

mounting means pivotally attached to said back portion and pivotally attached to said seat portion;

linkage means for defining a pivotally connected quadrilateral having first, second, third and fourth sides, said first side being fixed with respect to said back portion, said second side being connected to said first side and fixed with respect to said mounting means, said third side being connected to said second side, and said fourth side being connected between said third and first sides and fixed with respect to said base means;

said linkage means causing a predetermined amount of pivotal movement of said mounting means relative to said base means in response to pivotal movement of said back portion;

second power means for pivotally moving said seat portion into a desired position relative to said mounting means;

a plurality of switch means, each such switch means associated with actuation of a single one of said power means for movement of said back and said seat portions from one of said examination positions to at least a next following one of said positions within said sequence; and control means, responsive to said plurality of switch means, for controlling operation of said first and second power means in accordance with actuation of a selected one of said switch means.

9. The examination chair as defined in claim 8 wherein said first and said second power means each include not more than one lead screw actuator and an associated electric motor therefor, said actuator having a screw shaft adapted for rotation by said motor, nut means mounted on said shaft for converting the rotary motion of said shaft into linear motion, and actuator means connected to said nut means for delivering said linear motion to the corresponding chair portion.

* * * * *